United States Patent [19]

Langdon

[11] Patent Number: 4,708,460

[45] Date of Patent: Nov. 24, 1987

[54] SIMULTANEOUS TRANSFER AND FUSING IN ELECTROPHOTOGRAPHY

[75] Inventor: Michael J. Langdon, Pittsford, N.Y.

[73] Assignee: Xerox Corporation, Stamford, Conn.

[21] Appl. No.: 889,457

[22] Filed: Jul. 25, 1986

[51] Int. Cl.[4] ..... G03G 15/10

[52] U.S. Cl. ..... 355/10; 355/3 TR; 355/3 BE; 355/14 TR; 430/126

[58] Field of Search ..... 355/3 R, 3 TR, 3 BE, 355/14 TR, 10; 430/126

[56] References Cited

U.S. PATENT DOCUMENTS

| | | | |
|---|---|---|---|
| 2,990,278 | 6/1961 | Carlson | 355/3 X |
| 3,893,761 | 7/1975 | Buchan et al. | 355/3 R |
| 3,923,392 | 12/1975 | Buchan et al. | 355/3 R |
| 4,095,886 | 6/1978 | Koeleman et al. | 355/3 FU |
| 4,348,098 | 9/1982 | Koizumi | 355/3 TR |
| 4,435,067 | 3/1984 | Draai et al. | 355/3 TR |
| 4,453,820 | 6/1984 | Suzuki | 355/3 TR |
| 4,455,079 | 6/1984 | Miwa et al. | 355/3 TR |
| 4,531,825 | 7/1985 | Miwa et al. | 355/3 TR |
| 4,541,709 | 9/1985 | Kampschreur | 355/3 TR |
| 4,542,978 | 9/1985 | Tarumi et al. | 355/3 TR |

*Primary Examiner*—A. C. Prescott

*Attorney, Agent, or Firm*—H. Fleischer; J. E. Beck; R. Zibelli

[57] ABSTRACT

An apparatus in which a copy of an original document is formed. A liquid image is transferred from a photoconductive member to an intermediate member positioned closely adjacent thereto. The liquid image is subsequently simultaneously transferred and fused onto a copy sheet to form a copy of the original document.

24 Claims, 1 Drawing Figure

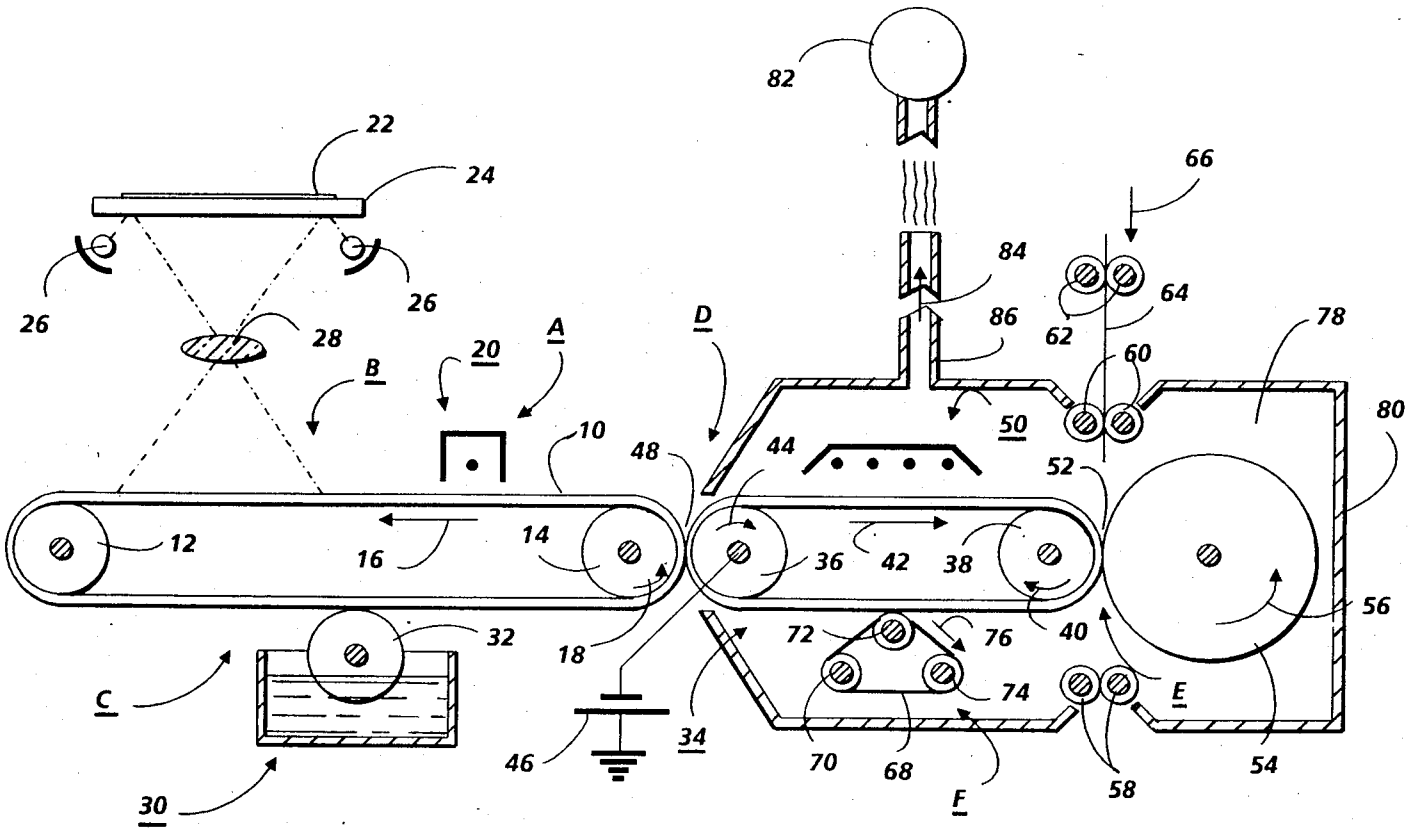
80
56
78
54
66
64
60
E
58
62
52
40
84
86
50
76
74
38
F
42
68
82
36
72
70
44
D
34
48
18
46
10
A
14
20
32
24
26
16
22
B
28
12
30
C
26

SIMULTANEOUS TRANSFER AND FUSING IN ELECTROPHOTOGRAPHY

This invention relates generally to an electrophotographic printing machine, and more particularly concerns a printing machine wherein a liquid image is transferred to an intermediate member and subsequently, simultaneously transferred and fused onto a copy sheet to form a copy of an original document being reproduced.

In electrophotographic printing, a charged photoconductive member is exposed to a light image of an original document. This records an electrostatic latent image on the photoconductive corresponding to the informational areas contained within the original document. Generally, the electrostatic latent image is developed by bringing a developer mixture into contact therewith. A dry developer mixture usually comprises carrier granules having toner particles adhering triboelectrically thereto. Toner particles are attracted from the carrier granules to the latent image forming a toner powder image thereon. Alternatively, a liquid developer material may be employed. The liquid developer material includes a liquid carrier having toner particles dispersed therein. The liquid developer material is advanced into contact with the electrostatic latent image and the toner particles are deposited thereon in image configuration. After the toner particles have been deposited on the photoconductive surface in image configuration, it is transferred to a copy sheet. Generally, when a liquid developer material is employed, the copy sheet is wet with both the toner particles and the liquid carrier. Thus, it becomes necessary to remove the liquid carrier from the copy sheet. This may be accomplished by drying the copy sheet prior to or subsequent to fusing the toner particles thereto, or relying upon the fusing process to permanently fuse the toner particles to the copy sheet as well as vaporizing the liquid carrier therefrom. Clearly, it is desirable to refrain from transferring any liquid carrier to the copy sheet. In this regard, it appears that it is advantageous to transfer the developed image to an intermediate web or belt and subsequently remove the liquid carrier therefrom prior to the transfer of the toner particles to the copy sheet. Hereinbefore, the toner particles transferred to the copy sheet were subsequently fused thereto, in image configuration, to form a copy of the original document. It is desirable to eliminate or reduce the number of processing stations in an electrophotographic printing machine employing an intermediate belt. Thus, it may be advantageous to both transfer and fuse the liquid image to the copy sheet at the same processing station. The following disclosures appear to be relevant:

U.S. Pat. No. 2,990,278
Patentee: Carlson
Issued: June 27, 1961

U.S. Pat. No. 3,893,761
Patentee: Buchan et al.
Issued: July 8, 1975

U.S. Pat. No. 3,923,392
Patentee: Buchan et al.
Issued: Dec. 2, 1975

U.S. Pat. No. 4,095,886
Patentee: Koeleman et al.

Issued: June 20, 1978

U.S. Pat. No. 4,348,098
Patentee: Koizumi
Issued: Sept. 7, 1982

U.S. Pat. No. 4,453,820
Patentee: Suzuki
Issued: June 12, 1984

U.S. Pat. No. 4,542,978
Patentee: Tarumi et al.
Issued: Sept. 24, 1985

The relevant portions of the foregoing patents may be briefly summarized as follows:

Carlson discloses a method and apparatus for transferring and fusing which utilizes a xerographic drum with an intermediate transfer belt. The initial transfer is achieved by corona charging. A radiant heater tacks the toner particles to the transfer belt. A pressure roll transfers the toner particles from the intermediate transfer belt to the copy sheet.

Buchan et al. ('761) describes an intermediate transfer belt made from a silicone rubber, which transfers the image from a first support material, through the use of pressure to a second support material, such as a copy sheet, by the use of heat and/or pressure. A radiant heater is employed to heat the toner on the silicone belt prior to transfer. Intermediate transfer may be achieved by drum to drum employing an electrostatic bias and pressure, and drum to belt using pressure.

Buchan et al. ('392) describes an intermediate transfer belt made from a silicone elastomer which pressure transfers the image from the photoreceptor to the final transfer and fusing stage. Intermediate transfer includes the use of a radiant heater with a heat shield. The final transfer stage is an elongated zone which allows the paper to absorb heat from the intermediate belt and transfers it from the copier.

Koeleman et al. discloses a photoreceptor belt, an intermediate transfer belt and a final transfer and fuse apparatus. The first transfer station employs pressure. The intermediate belt, made of silicone rubber, is heated by running over a heating device, or by any other means. The image is then transferred to the paper by pressure and contact. Insulated walls are employed to restrict the loss of energy and minimize irregular cooling.

Koizumi describes an intermediate transfer drum which is electrically biased by corona charging to effect transfer of the toner image thereto. The toner image is then transferred and fused to the copy sheet by pressure rolls.

Suzuki discloses an intermediate transfer belt made from silicone or RTV rubber which receives a toner image from a photoconductive drum through light pressure. The toner image is then radiantly heated to fusion temperature on the belt. Thereafter, a copy sheet is pressed against the belt to affect transfer of the toner image thereto.

Tarumi et al. discloses a high speed transfer apparatus employing a photoconductor and an intermediate belt. Transfer is effected by light contact therebetween. The intermediate belt wraps around a large diameter heating roller, and the toner image is subsequently transferred to the copy sheet through pressure between the heating roll and a second roll.

In accordance with one aspect of the present invention, there is provided an apparatus for forming a copy of an original document. The apparatus includes a member having a liquid image of liquid carrier with toner particles dispersed therein deposited thereon. An intermediate member is positioned to have a portion thereof closely adjacent the member. Means are provided for attracting the liquid image from the member to the intermediate member. Means transfer at least the toner particles from the intermediate member to the copy sheet and fuse simultaneously the toner particles to the copy sheet in image configuration to form the copy of the original document.

Pursuant to another aspect of the features of the present invention, there is provided an electrophotographic printing machine of the type having an electrostatic latent image recorded on the photoconductive member. Means develop the electrostatic latent image recorded on the photoconductive member with a liquid carrier having toner particles dispersed therein to form a liquid image thereon. An intermediate member is positioned to have a portion thereof closely adjacent the photoconductive member. Means attract the liquid image from the photoconductive member to the intermediate member. Means are provided for transferring at least the toner particles from the intermediate member to a copy sheet and fusing simultaneously the toner particles to the copy sheet in image configuration to form the copy of the original document.

Other aspects of the present invention will become apparent as the following description proceeds upon reference to the Figure.

BRIEF DESCRIPTION OF THE DRAWING

The FIGURE shows a schematic elevational view of an electrophotographic printing machine incorporating the simultaneous transferring and fusing features of the present invention therein.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawing. In the drawing, like reference numerals have been used throughout to designate identical elements. As shown, the drawing is a schematic elevational view illustrating an electrophotographic printing machine incorporating the features of the present invention therein. It will become apparent from the following discussion that the features of the present invention may be equally well suited for use in a wide variety of printing machines and is not necessarily limited in its application to the particular embodiment shown therein.

Turning now to the drawing, the electrophotographic printing machine employs a photoconductive member having a belt 10 entrained about a pair of opposed spaced rollers 12 and 14. Belt 10 includes a photoconductive surface mounted on a conductive substrate. Preferably, the photoconductive surface is made from a selenium alloy with a conductive substrate made from an aluminum alloy which is electrically grounded. One skilled in the art will appreciate that the photoconductive surface may be made from other materials, e.g. organic materials, and the conductive substrate may also be made from other materials, e.g. nickel. A series of processing stations are positioned about belt 10 such that as belt 10 advances in the direction of arrow 16, it passes sequentially therethrough. A motor (not shown) rotates roller 14 in the direction of arrow 18 to advance belt 10 in the direction of arrow 16. Timing detectors sense the advancement of belt 10 in the direction of arrow 16 and communicate with the machine logic to synchronize the various operations thereof. In this manner, the proper sequence of events is produced at the respective processing stations.

Belt 10 initially advances the photoconductive surface through charging station A. At charging station A, a corona generating device, indicated generally by the reference numeral 20, sprays ions onto the photoconductive surface producing a relatively high, substantially uniform charge thereon.

Next, the charged photoconductive surface is advanced to exposure station B. At exposure station B, an original document 22 is positioned face down upon a generally planar, substantially transparent platen 24. Lamps 26 flash light rays onto original document 22. The light rays reflected therefrom are transmitted through lens 28 to form a light image of the original document which is focused onto the charged portion of the photoconductive surface. This selectively dissipates the charge on the photoconductive surface to record an electrostatic latent image thereon corresponding to the informational areas in original document 22. While a light lens system has been described, one skilled in the art will appreciate that other techniques, such as modulated laser beams, may be employed to selectively dissipate the charged portion of the photoconductive surface to record the electrostatic latent image thereon.

After exposure, belt 10 advances the electrostatic latent image recorded on the photoconductive surface to development station C. Development station C includes a developer unit, indicated generally by the reference numeral 30. Developing unit 30 includes a roller 32 adapted to advance liquid developer material into contact with the electrostatic latent image recorded on the photoconductive surface. One skilled in the art will appreciate that a tray having an electrode adjacent the photoconductive belt may also be used to effect development of the latent image with the liquid developer material therein. By way of example, the liquid developer material may comprise an insulating liquid carrier material made from an aliphatic hydrocarbon, largely decane, which is manufactured by the Exxon Corporation under the trademark Isopar. Toner particles are dispersed in the liquid carrier. Preferably, toner particles are made predominantly from a pigmented material, such as a suitable resin including carbon black. A suitable liquid developer material is described in U.S. Pat. No. 4,582,774 issued Landa in 1986, the relevant portions thereof being hereby incorporated into the present application. The liquid image developed on the photoconductive surface is transported by belt 10 to transfer station D.

At transfer station D, the developed liquid image is transferred to an intermediate member or a belt, indicated generally by the reference numeral 34. Belt 34 is entrained about a pair of spaced rollers 36 and 38, respectively. A motor (not shown) is coupled to roller 38 to rotate roller 38 in the direction of arrow 40 to advance belt 34 in the direction of arrow 42. Roller 36 rotates freely in the direction of arrow 44. A voltage source 46 is coupled to roller 36 so as to electrically bias roller 36 to a suitable potential and polarity. This electrical bias, in turn, electrically biases belt 34. Belt 34 is positioned to contact the photoconductive surface of belt 10. The electrical bias applied on belt 34 in nip 48 is of a suitable polarity and magnitude to attract the liquid developed image thereto. Preferably, belt 34 is made from a somewhat electrically conductive silicone material, i.e. a material having an electrical conductivity of about $10^9$ ohm-centimeters. One skilled in the art will appreciate that there are many other ways of electrically biasing belt 34. For example, belt 34 may be changed by a corona generating device to a suitable magnitude and polarity to effect transfer of the liquid image from the photoconductive surface of belt 10 thereto.

Invariably, some residual liquid carrier and toner particles remain adhering to the photoconductive surface of belt 10 after the transfer thereof to belt 34. These residual particles and liquid carrier are removed from the photoconductive surface at the cleaning station (not shown). The cleaning station includes a flexible, resilient blade having the free end portion thereof in contact with the photoconductive surface to remove any material adhering thereto. Alternatively, a foam roller may be employed to remove the residual material adhering to the photoconductive surface. Thereafter, a lamp is energized to discharge any residual charge on the photoconductive surface preparatory for the next successive imaging cycle.

After the liquid image is transferred to intermediate belt 34, belt 34 advances the liquid image through a radiant heater, indicated generally by the reference numeral 50. Radiant heater 50 generates radiant energy in the infrared wave length which is selectively absorbed by the developed liquid image on belt 34. This vaporizes liquid carrier and partially melts the toner particles decreasing their viscosity. Radiant heater 50 includes an infrared quartz lamp which is mounted in a reflector assembly in opposing relationship to belt 34 and in a position to thermally communicate with the liquid image thereon. One skilled in the art will appreciate that any suitable radiant heater may be employed to preheat the liquid image as heretofore described. Furthermore, one skilled in the art will appreciate that oven or flash heating may be employed in lieu of radiant heating to preheat the toner particles and vaporized liquid carrier on belt 34.

After the liquid image is preheated, belt 34 advances the liquid image into nip 52 defined by fuser roller 54 and belt 34. Fuser roller 54 is resiliently urged into engagement with belt 34 to define nip 52. A suitable motor (not shown) rotates fuser roller 54 in the direction of arrow 56. Fuser roller 54 has a rigid internal core which may be steel, having a resilient sleeve-like covering thereover. The fuser roll sleeve is made from a flexible material, such as silicone rubber. To heat fuser roller 54, a lamp is disposed within the fuser roller core. The core has a suitable opening for receipt of the lamp. In this arrangement, heat energy from the lamp permeates through the metal core and outer sleeve to the heat the surface of fuser roller 54 to the requisite temperature. Forwarding rollers 58, 60 and 62 advance copy sheet 64 in the direction of arrow 66 through nip 52. As copy sheet 64 passes through nip 52, the heat and pressure applied thereon transfers the liquid image from belt 34 thereto. At this time, the remaining liquid carrier material is substantially vaporized. In addition, the toner particles are fused to the copy sheet. Thus, at transfer station E, the toner particles are transferred to the copy sheet, in image configuration, and simultaneously fused thereto.

After passing through nip 52 wherein the toner particles are transferred and fused to the copy sheet, copy sheet 64 advances to the catch tray (not shown) where the operator may remove the completed copy from the printing machine.

After belt 34 passes through nip 52, invariably, residual particles remain adhering thereto. These residual particles may be removed therefrom at cleaning station F. Cleaning station F includes a web 68 entrained about three rollers 70, 72 and 74 spaced from one another, defining the apexes of a triangle. Web 68 is driven in the direction of arrow 76. Web 68 contacts belt 34 and moves in the direction opposed thereto in the contact region to remove any residual particles thereon prior to belt 34 advancing to transfer station D, for the next successive cycle.

Intermediate belt 34, radiant heater 50, fuser roller 54 and web 68 are all located in chamber 78 of housing 80. A blower 82 is coupled via a conduit to housing 80 so as to create a slight negative pressure in chamber 78 causing a flow of air in the direction of arrow 84 through exit port 86 of housing 80. In this way, the vaporized liquid carrier is removed from chamber 78. The negative pressure prevents leakage of the vaporized liquid carrier to the rest of the printing machine. Forwarding rollers 58 and 60 are mounted in the exit and entrance passageways, respectively, of housing 80 so as to advance copy sheet 64 in the direction of arrow 66 through nip 52 for transferring and fusing the toner image thereto.

In recapitulation, it is clear that the liquid developed image is transferred to an intermediate belt, and, subsequently simultaneously transferred and fused onto the copy sheet. A system of this type dries the copy sheet and removes the vaporized liquid carrier at minimum cost and optimizes copy quality.

It is, therefore, evident that there has been provided in accordance with the present invention, an apparatus which fully satisfies the aims and advantages heretofore mentioned. While this invention has been described in conjunction with a preferred embodiment thereof, it is evident that many alternatives, modifications and variations will be apparent to those skilled in the art. Accordingly, it is intended to embrace all such alternatives, modifications, and variations that fall within the spirit and broad scope of the appended claims.

I claim:

1. An apparatus for forming a copy of an original document, including:

a member having a liquid image of liquid carrier with toner particles dispersed therein deposited thereon;

an intermediate member positioned to have a portion thereof closely adjacent said member;

means for attracting the liquid image from said member to said intermediate member; and means for transferring at least the toner particles from said intermediate member to a copy sheet and fusing simultaneously the toner particles to the copy sheet in image configuration to form the copy of the original document.

2. An apparatus according to claim 1, further including means for removing liquid carrier from said intermediate member.

3. An apparatus according to claim 2, wherein said transferring and fusing means includes means for applying heat and pressure to the copy sheet positioned in contact with the toner particles on said intermediate member to transfer the toner particles to the copy sheet and fuse the toner particles thereto.

4. An apparatus according to claim 3, wherein said applying means includes a heated roller resiliently urged into engagement with said intermediate member to define a nip through which the copy sheet passes.

5. An apparatus according to claim 4, wherein said intermediate member includes a belt entrained about a pair of spaced rollers with one of said pair of spaced rollers being opposed from said heated roller.

6. An apparatus according to claim 5, wherein said other of said pair of spaced rollers is in contact with said member.

7. An apparatus according to claim 6, wherein said attracting means includes means for electrically biasing said belt to attract toner particles from said member thereto.

8. An apparatus according to claim 7, further including a housing defining a chamber having said belt, said pair of rollers and said heated roller disposed therein.

9. An apparatus according to claim 8, further including means for exhausting air from the chamber of said housing to remove vaporized liquid carrier therefrom and to maintain a slight negative pressure in said housing to prevent the escape of the vaporized liquid carrier therefrom.

10. An apparatus according to claim 9, further including means for advancing the copy sheet through the nip defined by said heated roller and said belt disposed in the chamber of said housing.

11. An apparatus according to claim 10, further including means for heating the liquid image on said belt to vaporize liquid carrier therefrom before the liquid image thereon contacts the copy sheet.

12. An apparatus according to claim 11, further including means for cleaning said belt after toner particles have been transferred therefrom.

13. An electrophotographic printing machine of the type having an electrostatic latent image recorded on a photoconductive member, including:

means for developing the electrostatic latent image recorded on the photoconductive member with a liquid carrier having toner particles dispersed therein to form a liquid image thereon;

an intermediate member positioned to have a portion thereof closely adjacent said photoconductive member;

means for attracting the liquid image from said photoconductive member to said intermediate member; and means for transferring at least the toner particles from said intermediate member to a copy sheet and fusing simultaneously the toner particles to the copy sheet in image configuration to form the copy of the original document.

14. A printing machine according to claim 13, further including means for removing liquid carrier from said intermediate member.

15. A printing machine according to claim 14, wherein said transferring and fusing means includes means for applying heat and pressure to the copy sheet positioned in contact with the toner particles on said intermediate member to transfer the toner particles to the copy sheet and fuse the toner particles thereto.

16. A printing machine according to claim 15, wherein said applying means includes a heated roller resiliently urged into engagement with said intermediate member to define a nip through which the copy sheet passes.

17. A printing machine according to claim 16, wherein said intermediate member includes a belt entrained about a pair of spaced rollers with one of said pair of spaced rollers being opposed from said heated roller.

18. A printing machine according to claim 17, wherein said other of said pair of spaced rollers is in contact with said member.

19. A printing machine according to claim 18, wherein said attracting means includes means for electrically biasing said belt to attract toner particles from said member thereto.

20. A printing machine according to claim 19, further including a housing defining a chamber having said belt, said pair of rollers and said heated roller disposed therein.

21. A printing machine according to claim 20, further including means for exhausting air from the chamber of said housing to remove vaporized liquid carrier therefrom and to maintain a slight negative pressure in said housing to prevent the escape of the vaporized liquid carrier therefrom.

22. A printing machine according to claim 21, further including means for advancing the copy sheet through the nip defined by said heated roller and said belt disposed in the chamber of said housing.

23. A printing machine according to claim 22, further including means for heating the liquid image on said belt to vaporize liquid carrier therefrom before the liquid image thereon contacts the copy sheet.

24. A printing machine according to claim 23, further including means for cleaning said belt after toner particles have been transferred therefrom.

* * * * *